US006283467B1

(12) United States Patent
Iida

(10) Patent No.: US 6,283,467 B1
(45) Date of Patent: Sep. 4, 2001

(54) SHEET-LIKE OBJECT CONVEY APPARATUS FOR SHEET-FED ROTARY PRINTING PRESS

(75) Inventor: Hirotaka Iida, Ibaragi (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/512,901

(22) Filed: Feb. 25, 2000

(30) Foreign Application Priority Data

Feb. 26, 1999 (JP) ..... 11-050423

(51) Int. Cl.[7] ..... B65H 29/06
(52) U.S. Cl. ..... 271/82; 101/409; 101/410
(58) Field of Search ..... 271/277, 82; 101/408, 101/409, 410

(56) References Cited

U.S. PATENT DOCUMENTS

| | | | | |
|---|---|---|---|---|
| 2,577,099 | | 12/1951 | Albrecht . | |
| 3,332,345 | | 7/1967 | Smyth . | |
| 3,534,683 | * | 10/1970 | Barthel | 271/82 |
| 4,098,187 | * | 7/1978 | Wirz | 101/410 |
| 5,271,323 | * | 12/1993 | Munker | 101/409 |
| 6,109,173 | * | 8/2000 | Nakayana | 101/410 |

FOREIGN PATENT DOCUMENTS

| | | | | |
|---|---|---|---|---|
| 642365 | * | 6/1962 | (CA) | 271/82 |
| 11 59 471 | | 2/1960 | (DE) . | |
| 11 74 801 | | 2/1960 | (DE) . | |
| 15 61 072 | | 1/1970 | (DE) . | |
| 1 909 795 | | 7/1970 | (DE) . | |
| 0 372 237 | | 6/1990 | (EP) . | |
| 0 638 497 | | 2/1995 | (EP) . | |
| 6-336003 | | 12/1994 | (JP) . | |
| 7-052361 | | 2/1995 | (JP) . | |

* cited by examiner

*Primary Examiner*—H. Grant Skaggs
(74) *Attorney, Agent, or Firm*—Blakely Sokoloff Taylor & Zafman

(57) ABSTRACT

In a sheet-like object convey apparatus for a sheet-fed rotary printing press a cylinder shaft is rotatably supported between a pair of frames and rotatably driven during conveyance of a sheet-like object. Gripper pads and grippers grip an end of a sheet-like object conveyed from an upstream side of a sheet convey direction. A gripper pad bar and gripper shaft are supported by the cylinder shaft, to support the gripper pads and grippers in an axial direction of the cylinder shaft. A rod is rotatably supported parallel to the cylinder shaft and has an eccentric large-diameter portion. A lever, cam follower, and cam rotate the rod through a predetermined angle by rotation of the cylinder shaft. Press members are rotatably fitted on the large-diameter portion of the rod, to be displaced in a radial direction along with rotation of the rod. Press levers and braking members convert displacement of the press members, while in surface contact with them, into a pressure in a direction perpendicular to the gripper pad bar and gripper shaft, to deflect them in the sheet convey direction.

11 Claims, 7 Drawing Sheets

SHEET-LIKE OBJECT CONVEY APPARATUS FOR SHEET-FED ROTARY PRINTING PRESS

BACKGROUND OF THE INVENTION

The present invention relates to a sheet-like object convey apparatus for a sheet-fed rotary printing press, which grips the end of a sheet-like object fed from the upstream side of the convey direction and conveys it to an impression cylinder.

Generally, in a sheet convey apparatus of this type, sheets stacked on a feed unit are attached by the suction port of a sucker unit one by one, are fed onto a feeder board by rotation of a feed roller, and are conveyed on the feeder board toward a feedboard by a feed tape or the like. The sheets fed onto the feedboard are jogged at their leading ends by a register, and are gripped by the grippers of a swing. The gripped sheet is conveyed to the impression cylinder of a printing press by the swing motion of the swing pivotally supported by a swing shaft, and is then gripped by the grippers of the impression cylinder.

In the sheet convey apparatus of this type, the trailing side of the sheet expands or shrinks in the right-to-left direction (a direction perpendicular to the sheet convey direction) by a high pressure and a water content supplied when the sheet is subjected to printing. When the sheet expands or shrinks, printing registration called fan-out registration of the sheet on the trailing edge for multi-color printing causes misregistration, leading to defective printing. This problem is solved in Japanese Patent Laid-Open No. 7-52361.

The sheet convey apparatus described in this reference has a rod, a slide member, and a cam plate. The rod is axially slidable, supported in a swing shaft. The slide member moves together with the rod and has a cam follower. The cam plate is fixed to a gripper pad and has a tapered cam surface. The cam follower comes into contact with the cam plate. In this arrangement, when the swing shaft swings, the rod reciprocally moves in the axial direction accordingly, and the slide member also reciprocally moves in the axial direction. Then, the cam follower slides on the cam surface of the cam plate, and grippers which grip a sheet, and a gripper shaft supporting the gripper pad are deflected in the sheet convey direction.

In this state, when the sheet is transferred to the grippers of the cylinder and the gripper pad is restored to the straight state, the two ends of the sheet are pulled by the grippers at the two ends so that the trailing end of the sheet is stretched taut. As a result, even if the trailing side of the sheet expands or shrinks in the right-to-left direction, the trailing end of the sheet is stretched taut until the sheet is gripped by the cylinder. Therefore, the expansion and shrink of the sheet are corrected, so that the fan-out registration is corrected.

In the sheet-like object convey apparatus for the conventional sheet-fed rotary printing press described above, while the rod moves in the axial direction, the cam follower brought into tight contact with the cam surface of the cam plate rolls on the cam surface and does not come into slidable contact with it. At the right and left moving ends of the rod, however, the cam follower is in slidable contact with the cam surface. More specifically, at the right and left moving ends of the rod where the moving direction of the cam follower changes, the rod is temporarily stopped, and movement of the cam follower is stopped accordingly. Since a rolling inertia acts on the cam follower, the cam follower is temporarily rotated in the rolling direction while it is stopped. As a result, the surface of the cam follower is brought into slidable contact with the cam surface.

In this case, the cam surface with which the cam follower comes into slidable contact has a certain length with respect to the moving length in the right-to-left direction of the rod which deflects the gripper pad. For example, when the moving length of the rod is several mm, the length of the slidable contact of the cam surface is in units of mm. In addition, in the conventional sheet-like object convey apparatus for the sheet-fed rotary printing press described above, since the cam follower is urged against the cam surface of the cam plate with a high pressure due to linear contact, a load is concentrated on that portion of the cam follower which is urged by the cam surface. While the load is concentrated on the cam surface and part of the cam follower in this manner, the cam follower comes into slidable contact with the cam surface. Hence, the cam surface and part of the cam follower tend to wear easily, posing a problem on durability.

SUMMARY OF THE INVENTION

It is an object of the present invention to provide a sheet-like object convey apparatus for a sheet-fed rotary printing press, which has an improved durability.

In order to achieve the above object, according to the present invention, there is provided a sheet-like object convey apparatus for a sheet-fed rotary printing press, comprising a rotary shaft rotatably supported between a pair of frames and rotatably driven during conveyance of a sheet-like object, a plurality of gripper units for gripping an end of the sheet-like object conveyed from an upstream side of a sheet convey direction, a support shaft supported by the rotary shaft to support the gripper units in an axial direction of the rotary shaft, a rod rotatably supported parallel to the rotary shaft and having an eccentric large-diameter portion, a driving mechanism for rotating the rod through a predetermined angle by rotation of the rotary shaft, a tubular member rotatably fitted on the large-diameter portion of the rod to be displaced in a radial direction along with rotation of the rod, and a press mechanism for converting, while in surface contact with the tubular member, displacement of the tubular member into a press force in a direction perpendicular to the support shaft, to deflect the support shaft in the sheet convey direction.

DESCRIPTION OF THE PREFERRED EMBODIMENT

The present invention will be described in detail with reference to the accompanying drawings.

Figure 1:
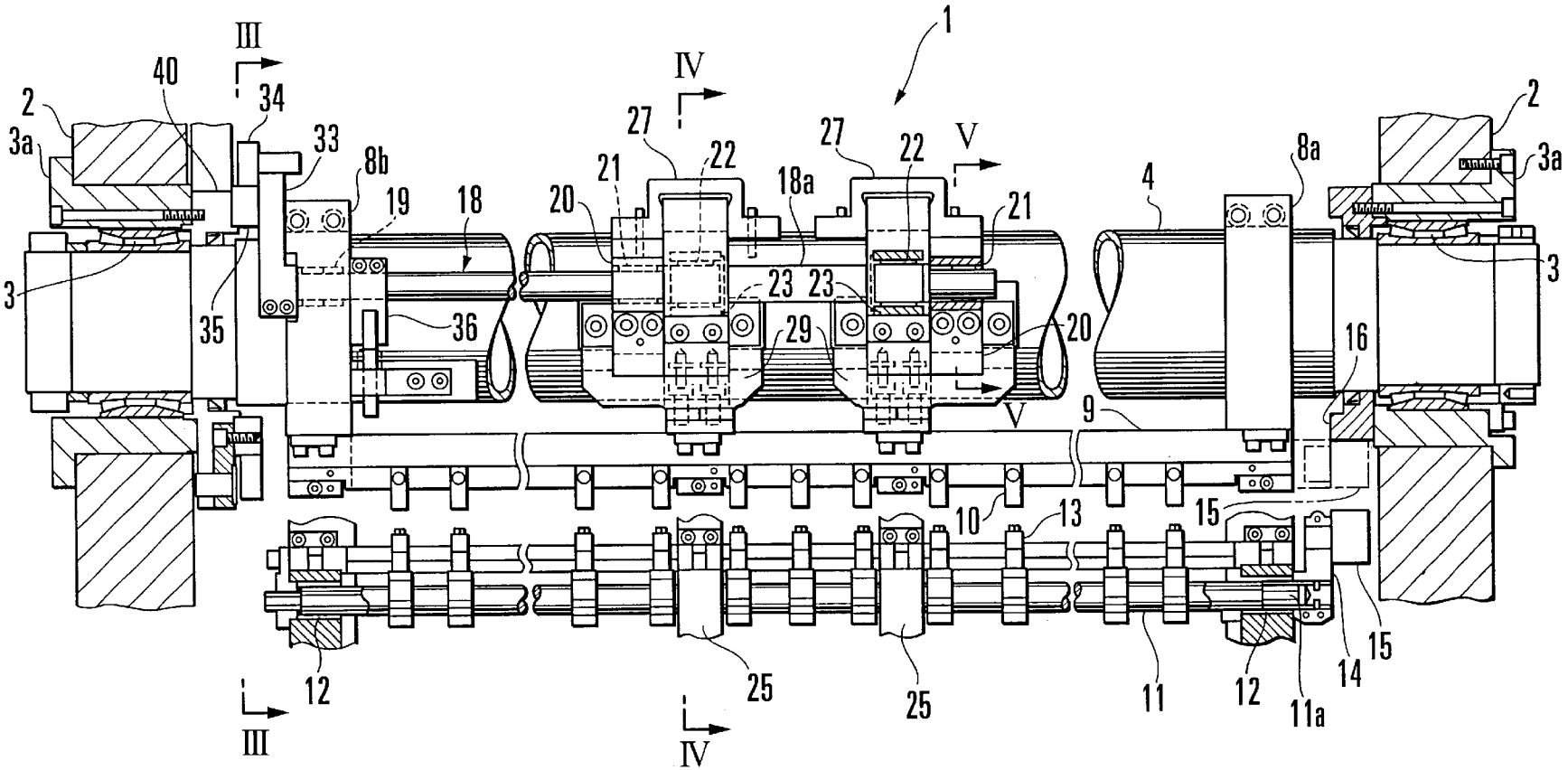
FIG. 1 is a partly sectional front view of a sheet-like object convey apparatus for a sheet-fed rotary printing press according to an embodiment of the present invention.

FIG. 1 shows part of a sheet-like object convey apparatus for a sheet-fed rotary printing press according to the present invention.

Referring to FIG. 1, a swing 1 constituting the sheet convey apparatus for the sheet-fed printing press has a hollow sheet feed cylinder shaft 4 rotatably supported by a pair of right and left frames 2, opposing each other through a predetermined gap, through holders 3*a* and bearings 3. The upper ends of a pair of opposing support levers 8*a* and 8*b* are fixed to the two ends of the sheet feed cylinder shaft 4, and a gripper pad bar 9 is fixed between the support levers 8*a* and 8*b*. A plurality of gripper pads 10 are fixed to the gripper pad bar 9 in an array in the axial direction of the sheet feed cylinder shaft 4 at substantially a predetermined interval.

A gripper shaft 11 is rotatably supported at the lower ends of the support levers 8*a* and 8*b* through bearings 12 to be parallel to the gripper pad bar 9. A plurality of grippers 13 are fixed to the gripper shaft 11 to come into contact with the gripper pads 10. The gripper pads 10 and grippers 13 form gripper units. One end of a lever 14 is fixed to the projecting end of the gripper shaft 11 projecting from one support lever 8*a*, and a roller 15 is pivotally supported at the other end of the lever 14.

A full arc cam 16 having small- and large-diameter portions is fixed to each frame 2 through the holder 3*a* to be rotatable with respect to the sheet feed cylinder shaft 4. The roller 15 is constantly pressed toward the corresponding full arc cam 16 by the torsional moment of a torsion bar 11*a* accommodated in the gripper shaft 11, and is biased to swing in a direction to close the grippers 13.

Figure 2:
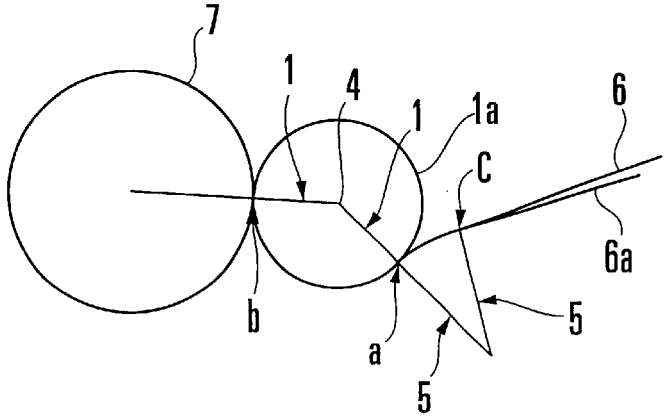
FIG. 2 is a view for explaining the operation of the sheet-like object convey apparatus shown in FIG. 1.

When the sheet feed cylinder shaft 4 is rotated and the grippers 13 of the gripper shaft 11 are located at a point a as shown in FIG. 2, the gripper shaft 11 is rotated through a predetermined angle by the torsional moment of the torsion bar 11*a*. Accordingly, the grippers 13 come into contact with the gripper pads 10 to grip the end of a paper sheet 6 as a sheet-like object. When the grippers 13 of the gripper shaft 11 are located at a point b, the roller 15 comes into contact with the large-diameter portion of the corresponding full arc cam 16, and restores the gripper shaft 11 through the lever 14 against the torsional moment of the torsion bar 11*a*. Therefore, the grippers 13 separate from the gripper pads 10, and gripping change of the paper sheet 6 to an impression cylinder 7 is performed.

Figure 4:
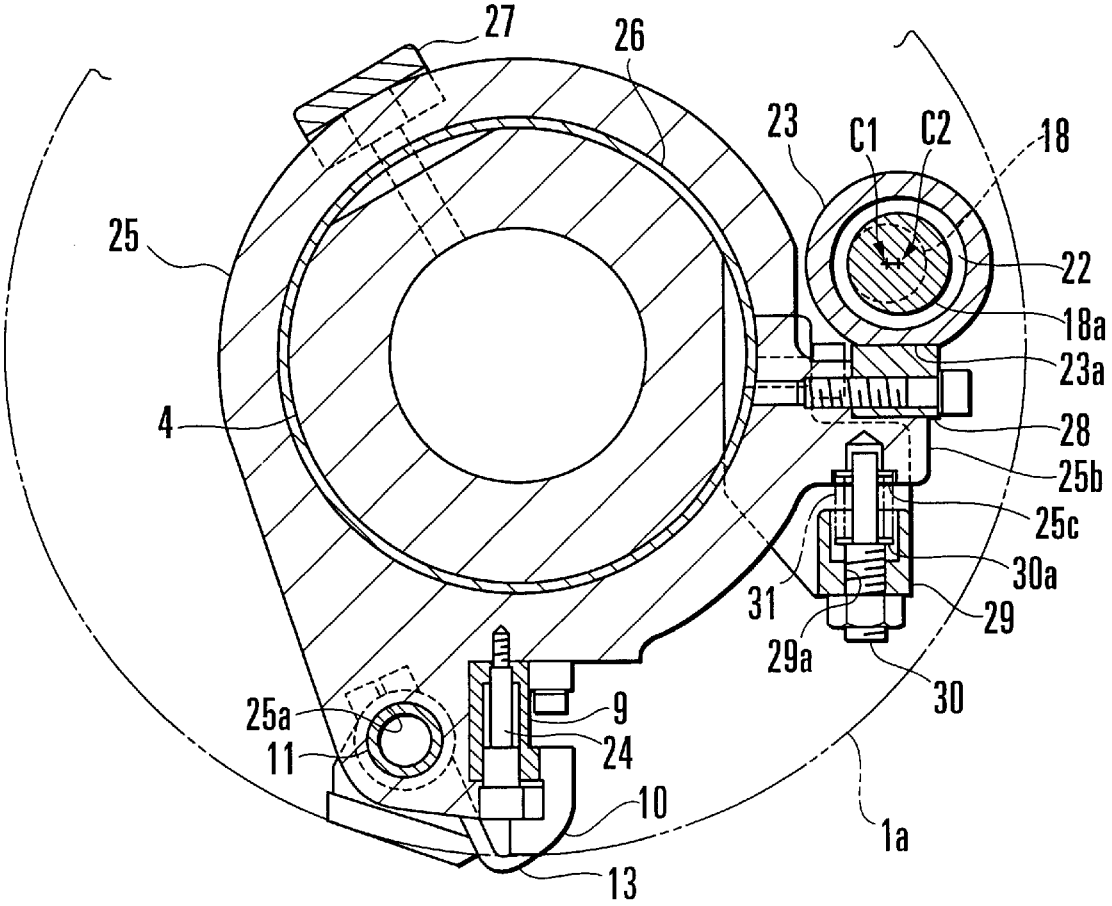
FIG. 4 is a sectional view taken along the line IV—IV in FIG. 1.
Figure 5:
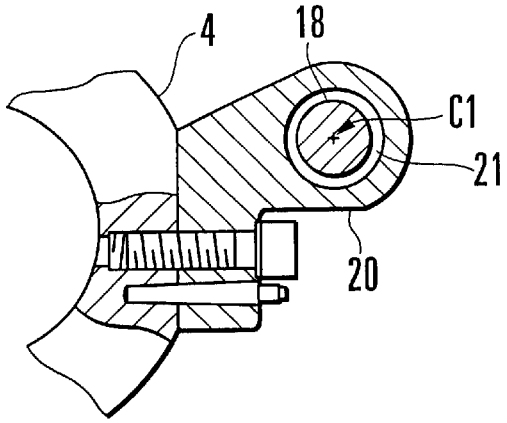
FIG. 5 is a sectional view taken along the line V—V in FIG. 1.

Referring to FIG. 1, a round rod 18 having a large-diameter portion 18*a* at its one end is rotatably supported, through a bearing 19 of the support lever 8*b* and bearings 21 (FIG. 5) of a pair of bearing members 20 fixed to the sheet feed cylinder shaft 4, to be parallel to the sheet feed cylinder shaft 4. A pair of cylindrical press members (tubular members) 23 are rotatably fitted on the large-diameter portion 18*a* of the rod 18 through bearings 22. As shown in FIG. 4, a chamfered portion 23*a* serving as a flat engaging portion is formed on part of the outer surface of each press member 23. Rotation centers C2 of the bearings 22 which rotatably support the press members 23 onto the rod 18 are eccentric from rotation centers C1 of the bearings 19 and 21 which rotatably support the rod 18.

A pair of press levers (rotary members) 25 are rotatably fitted on the sheet feed cylinder shaft 4 through bushes 26 to correspond to the pair of press members 23. Movement of the press levers 25 in the axial direction is regulated by holders 27 fixed to the sheet feed cylinder shaft 4. As shown in FIG. 4, a fitting hole 25*a* through which the gripper shaft 11 is inserted is formed in the peripheral portion of each press lever 25, and a projection 25*b* having a recess 25*c* is formed at that peripheral position of each press lever 25 which forms an angle of substantially 90° with the corresponding fitting hole 25*a*. The gripper pad bar 9 is fixed to the press levers 25 with bolts 24.

A rectangular parallelepiped braking member 28 serving as an engaging member is fixed to the projection 25*b* of each press lever 25. A set screw 30 is threadably engaged with a threaded portion 29*a* of each blanket 29 fixed to the sheet feed cylinder shaft 4. A compression coil spring 31 is elastically mounted between a flange 30*a* of the set screw 30 and the recess 25*c* of the press lever 25. Accordingly, the press levers 25 are biased to rotate counterclockwise in FIG. 4 about the sheet feed cylinder shaft 4 as the center, and the braking members 28 are accordingly brought into tight contact with the chamfered portions 23*a* of the press members 23.

Figure 3:
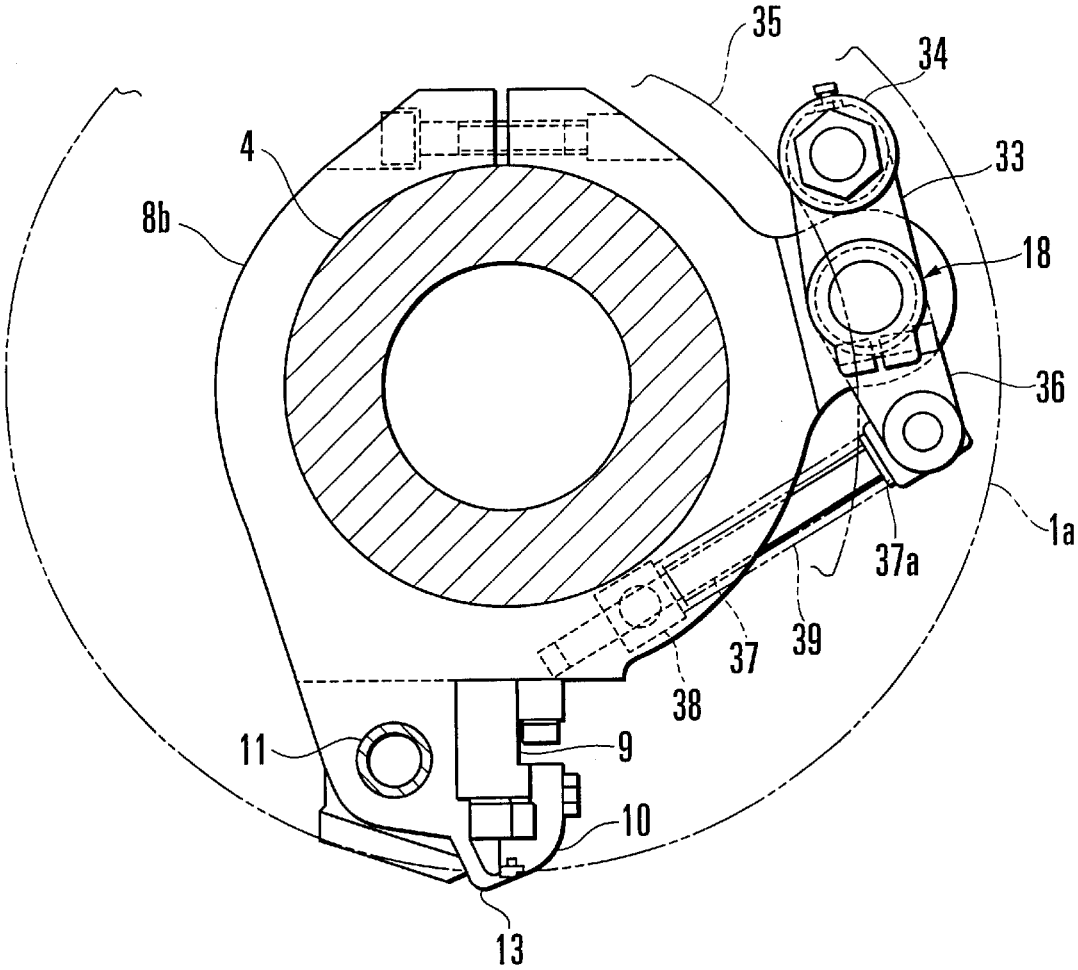
FIG. 3 is a sectional view taken along the line III—III in FIG. 1.

Referring to FIG. 1, one end of a lever 33 is axially mounted on the projecting end of the rod 18 projecting from the support lever 8*b*, and a cam follower 34 is pivotally mounted on the swing end of the lever 33. A cam 35 (described later) comprised of a stationary cam 35*a* and movable cam 35*b* is set to come into contact with the cam follower 34. One end of a lever 36 is axially mounted on that portion of the rod 18 which is adjacent to the inner side of the support lever 8*b*. As shown in FIG. 3, a head 37*a* of a rod 37 is pivotally mounted on the swing end of the lever 36. The rod 37 is slidably supported in the fitting hole of a stud 38 fixed to the support lever 8*b*. A compression coil spring 39 wound on the rod 37 is elastically mounted between the stud 38 and the head 37*a* of the rod 37. The rod 18 is biased by the elastic force of the compression coil spring 39 through the lever 36 to swing counterclockwise in FIG. 4, and the cam follower 34 is brought into tight contact with the cam 35 through the lever 33.

Figure 6:
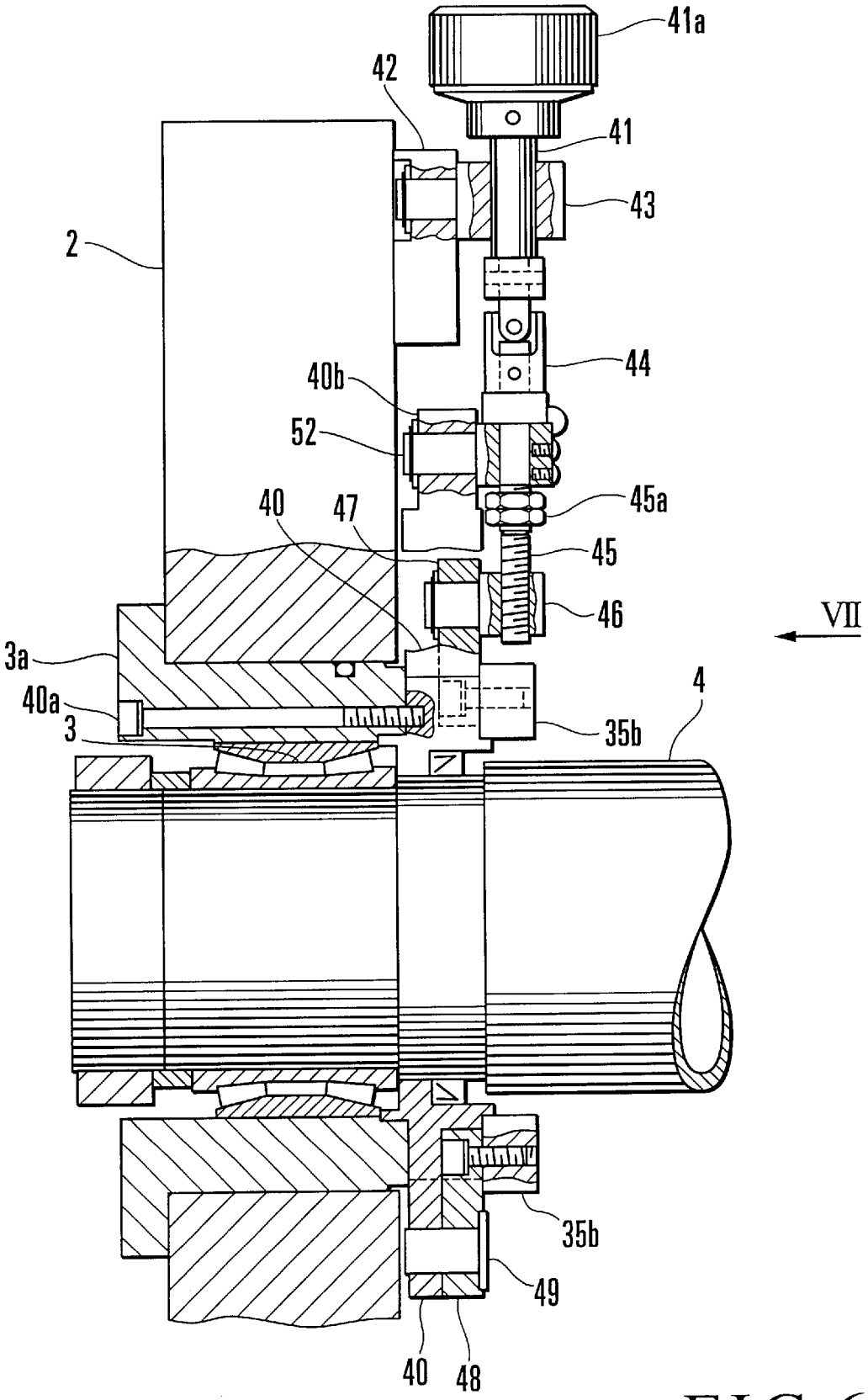
FIG. 6 is an enlarged front view of the main part of the sheet-like object convey apparatus shown in FIG. 1.
Figure 7:
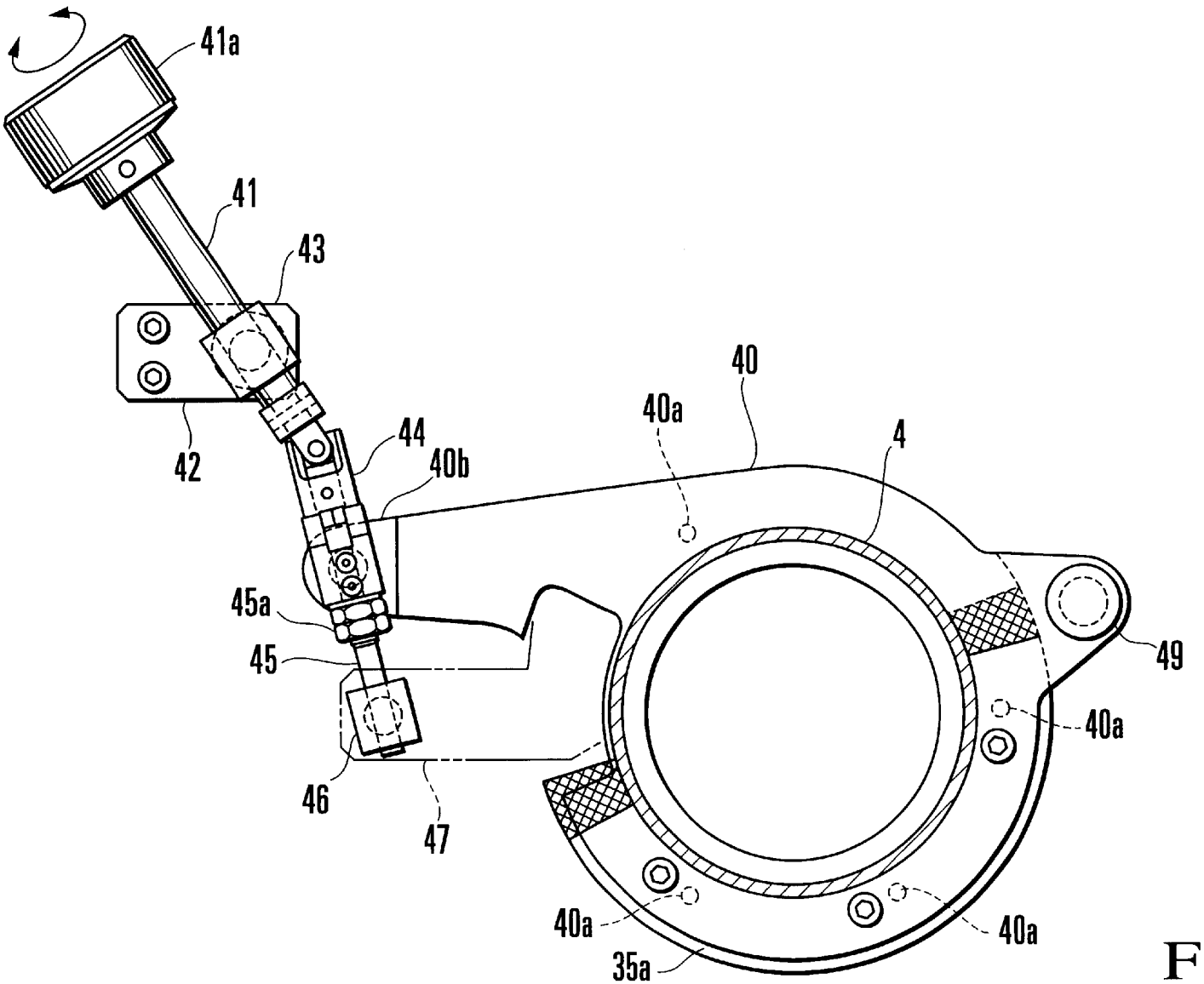
FIG. 7 is a view seen from the direction of an arrow VII in FIG. 6.

As shown in FIG. 6, a stationary cam attaching ring 40 formed substantially annularly is provided around the sheet feed cylinder shaft 4 to come close to the frame 2, and is fixed to the corresponding holder 3*a* with bolts 40*a*. As shown in FIG. 7, the semi-annular stationary cam 35*a* is fixed to the stationary cam attaching ring 40 along the outer surface of the sheet feed cylinder shaft 4.

Figure 8:
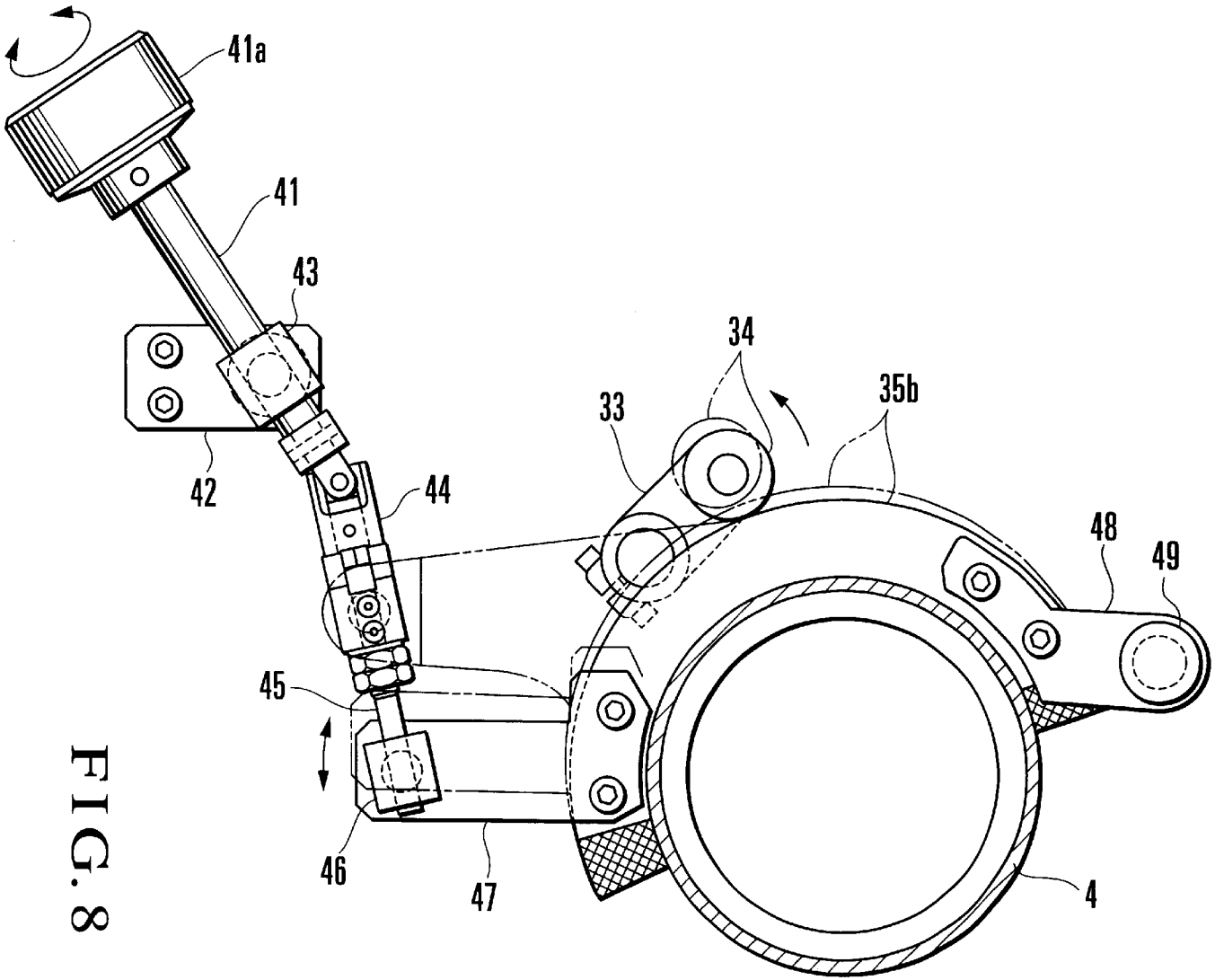
FIG. 8 is a view seen from the direction of an arrow VII in FIG. 6.

As shown in FIGS. 6 and 8, an operation rod 41 having a knob 41*a* is fitted in the fitting hole of a stud 43 pivotally mounted to a base 42 fixed to the frame 2, and is rotatably supported. The distal end of the operation rod 41 is connected to one end of a connecting member 44 through a universal coupling, and a screw rod 45 is threadably engaged with the hollow threaded portion of the connecting member 44 at the other end. The screw rod 45 projecting from the connecting member 44 is fixed to the connecting member 44 with a double nut 45*a*.

Referring to FIG. 8, when the knob 41*a* is rotated to rotate the screw rod 45 through the operation rod 41 and connecting member 44, the movable cam 35*b* swings about a pin 49 as the swing center so as to come close to and separate from the sheet feed cylinder shaft 4, as indicated by an alternate long and two short dashed line in FIG. 8. The screw rod 45 is threadably engaged with the threaded portion of a stud 46. The stud 46 is pivotally supported on one end of a bracket 47. One end of the semi-annular movable cam 35*b* is fixed to the other end of the bracket 47.

As shown in FIG. 6, a support lever 48 is mounted on the other end of the movable cam 35*b* provided along the outer surface of the sheet feed cylinder shaft 4. The support lever 48 is pivotally mounted on the stationary cam attaching ring 40 through the pin 49. More specifically, the support lever 48 is supported to be swingable toward the frame 2 about the pin 49 as the swing center.

The stationary cam 35*a* and movable cam 35*b* are mounted around the sheet feed cylinder shaft 4 to oppose each other. One pair of open ends of the cams 35*a* and 35*b* (portions cross-hatched in FIGS. 7 and 8 for the sake of illustrative convenience) have a small thickness. When these open ends are laid on each other, the cams 35*a* and 35*b* are arranged annularly.

This aims at preventing formation of a seam between the cams 35*a* and 35*b*. More specifically, in sheet convey operation (to be described later), when the cam follower 34 moves while coming into contact with the surfaces of the cams 35*a* and 35*b*, a trouble of the machine during printing, which is caused by engagement of the cam follower 34 between the cams 35*a* and 35*b*, is prevented. A support 40*b* formed to project from the stationary cam attaching ring 40 (described above) is pivotally mounted on the connecting member 44 through a pin 52, as shown in FIG. 6.

For the sake of illustrative convenience, the stationary cam 35*a* is not shown in FIG. 7, and the movable cam 35*b* is not shown in FIG. 8.

Sheet convey operation in the sheet-like printing product convey apparatus having the above arrangement will be described.

As shown in FIG. 2, the paper sheet 6 conveyed to a position c of the register of a feedboard 6*a* is gripped by a lower swing 5, and is conveyed to the sheet gripping position a of a sheet feed cylinder 1*a* by the swing motion of the lower swing 5. The paper sheet 6 conveyed to the position a is gripped by the grippers of the gripper shaft, as will be described later, and is conveyed to a gripping change position b of the impression cylinder 7 by rotation of the sheet feed cylinder shaft 4. The sheet feed cylinder shaft 4 is rotated by a motor as a driving source through a gear, in the same manner as the impression cylinder 7.

When the sheet feed cylinder shaft 4 is driven by the motor to rotate, and the swing 1 swings from the position of the point b to the position of the point a, the support levers 8*a* and 8*b* swing, together with the gripper pad bar 9 and gripper shaft 11, about the sheet feed cylinder shaft 4 as the shaft. When the gripper shaft 11 swings, the roller 15 comes into contact with the small-diameter portion of the full arc cam 16, and the gripper shaft 11 is rotated by the torsional moment of the torsion bar 11*a*. Hence, the end of the paper sheet 6 is gripped at the position of the point a by the plurality of pairs of grippers 13 and gripper pads 10.

Simultaneously, as the sheet feed cylinder shaft 4 rotates, the cam follower 34 moves around it to ride on the movable cam 35*b*, as shown in FIG. 8. Accordingly, the rod 18 is rotated clockwise in FIG. 3.

Figure 9:
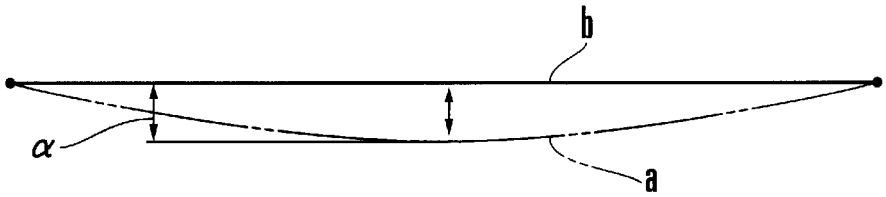
FIG. 9 is a view showing the position of a gripper in a sheet gripping state and that in a gripping change state of the sheet-like object convey apparatus shown in FIG. 1.

When the rod 18 rotates, the press members 23 having the rotation centers C2 eccentric from the rotation center C2 of the rod 18 are slightly displaced through the bearings 22 in a direction to come close to the projections 25*b* of the press levers 25, as shown in FIG. 4. Upon displacement of the press members 23, the press levers 25 are slightly rotated clockwise about the sheet feed cylinder shaft 4 as the center, against the elastic force of the compression coil springs 31. The clockwise rotational moment of the press levers 25 displaces the gripper shaft 11 fitted in the fitting holes 25*a* of the press levers 25, and the gripper pad bar 9 fixed to the press levers 25 with the bolts 24. Thus, the central portions of the gripper shaft 11 and gripper pad bar 9 are deflected by $\alpha$, as indicated by an alternate long and two short dashed line in FIG. 9.

When the gripper shaft 11 and gripper pad bar 9 are deflected, of the plurality of sets of grippers 13 and gripper pads 10 which grip the paper sheet 6 at the position of the point a, a set located at the central portion is retreated from the sets on its two sides by $\alpha$. From this state, the sheet feed cylinder shaft 4 swings and the swing 1 swings from the position of the point a to the position of the point b. Then, the cam follower 34 comes into contact with the stationary cam 35*a*, and the rod 18 shown in FIG. 3 rotates counterclockwise. When the rod 18 rotates, the press members 23 shown in FIG. 4 are slightly displaced through the bearings 22 in a direction to separate from the projections 25*b* of the press levers 25. When the press members 23 are displaced, the press levers 25 are slightly rotated, by the elastic force of the compression coil spring 31, counterclockwise about the sheet feed cylinder shaft 4 as the swing center.

When the press levers 25 rotate, the pressure applied by the press levers 25 onto the gripper shaft 11 and gripper pad bar 9 is canceled. The deflected gripper shaft 11 and gripper pad bar 9 are restored to the straight state, as indicated by a solid line in FIG. 9, and the plurality of grippers 13 on the gripper shaft 11 and the plurality of gripper pads 10 on the gripper pad bar 9 are aligned straight. Accordingly, the central set of gripper 13 and gripper pad 10 are moved. Consequently, the two ends of the paper sheet 6 are pulled by the sets of grippers 13 and gripper pads 10 at the two ends, to tautly stretch the trailing end of the sheet 6. Even if the trailing side of the paper sheet 6 expands or shrinks in the right-to-left direction, it is kept taut before the gripping change to correct the expansion and/or shrinkage. As a result, the fan-out registration can be corrected.

During this correction, despite rotation of the rod 18, rotation of the press members 23 rotatably supported on the large-diameter portion 18*a* of the rod 18 through the bearings 22 is regulated by the chamfered portions 23*a* and braking members 28, as shown in FIG. 4. Therefore, the press members 23 press the braking members 28 toward the engaging surfaces of the chamfered portions 23*a* and braking members 28, while they are almost set still and in surface-contact with the braking members 28.

Figure 10:
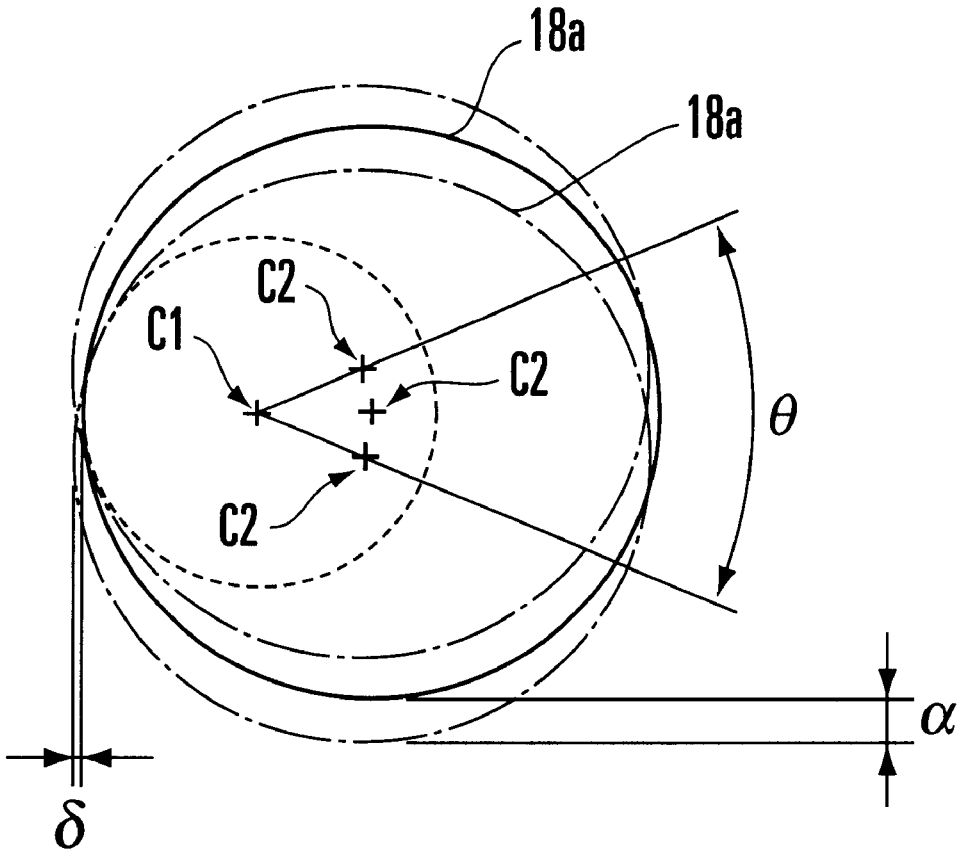
FIG. 10 is a view for explaining the displacing movements of the large-diameter portion of the rod in the sheet gripping and gripping change states.

This will be described in detail. As shown in FIG. 10, when the large-diameter portion 18*a* of the rod 18 is pivoted through an angle $\theta$, a displacement amount $\alpha'$ of the large-diameter portion 18*a* in a direction to come close to/separate from the braking members 28 is proportional to the deflection amount $\alpha$ of the gripper shaft 11 and gripper pad bar 9 shown in FIG. 9 ($\alpha = k \cdot \alpha'$ where k is a positive coefficient). In contrast to this, a displacement amount $\delta$ of the large-diameter portion 18*a* in a direction parallel to the engaging surface of the braking member 28 is very small with respect to the displacement amount $\alpha'$. For example, while $\alpha$ is in units of mm, $\delta$ is in units of $\mu$m. Hence, the chamfered portions 23*a* of the press members 23 do not substantially slide on the braking members 28.

Since the chamfered portions 23*a* of the press members 23 are urged by the braking members 28 in surface contact, the pressure produced by the chamfered portions 23*a* is dispersed. Accordingly, the chamfered portions 23*a* of the press members 23 press the braking members 28 in a substantially still state and surface contact state, so that wear of the press members 23 and braking members 28 can be reduced, thus improving the durability.

To deflect the gripper shaft 11 and gripper pad bar 9 to follow rotation of the sheet feed cylinder shaft 4, the rod 18 is rotated by bringing the cam follower 34 of the lever 33 axially mounted on the rod 18 into contact with the cam 35 fixed to the frame 2. Therefore, no special driving source is needed to rotate the rod 18. Not only the number of components is reduced, but also the structure is simplified.

A case will be described wherein the deflection amount $\alpha$ of the gripper shaft 11 and gripper pad bar 9 is to be adjusted to cope with a change in expanding amount (or shrinking amount) of the paper sheet 6 on the trailing side.

Referring to FIG. 8, when the screw rod 45 is rotated by operating the knob 41*a*, the stud 46 is moved, and the bracket 47 is moved in the circumferential direction of the sheet feed cylinder shaft 4. As the bracket 47 moves, the movable cam 35*b* swings clockwise or counterclockwise about the pin 49 as the swing center, to change the ride amount with which the cam follower 34 rides on the movable cam 35*b*. Hence, the rotating amount of the rod 18 changes, and the press amount with which the press members 23 press the press levers 25 also changes, so that the deflection amount of the gripper shaft 11 and gripper pad bar 9 can be changed.

In this manner, the deflection amount of the gripper shaft 11 and gripper pad bar 9 can be changed by only rotating the knob 41*a* attached to the frame 2. Since the deflection amount of the gripper pad bar 9 can be adjusted without stopping the printing press but in the operating state, the productivity can be improved. Also, since this adjustment can be performed while performing registration, precise adjustment can be performed.

In this embodiment, the present invention is applied to the swing 1 of the rotatable sheet feed cylinder 1*a*. Alternatively, the present invention can also be applied to a reciprocally movable swing. The rotary member need not be the sheet feed cylinder 1*a*, but can be another cylinder such as a sheet convey cylinder, a transfer cylinder, or the like. Although the object to be conveyed is a sheet, it can be any sheet-like printing product having a surface which can be subjected to printing.

The projections 25*b* of the press levers 25 can be directly pressed by the press members 23. In this case, the braking members 28 can be omitted.

As has been described above, according to the present invention, the tubular member presses the rotary member in a direction parallel to the engaging surface of the rotary member, while the tubular member is substantially set still. Since the tubular member and the rotary member are brought into surface contact with each other, the load is dispersed. As a result, the tubular member and the rotary member do not substantially wear, and the durability is improved.

What is claimed is:

1. A sheet-like object convey apparatus for a sheet-fed rotary printing press, comprising:

a rotary shaft rotatably supported between a pair of frames and rotatably driven during conveyance of a sheet-like object;

a plurality of gripper units for gripping an end of the sheet-like object conveyed from an upstream side of a sheet convey direction;

a support shaft supported by said rotary shaft to support said gripper units in an axial direction of said rotary shaft;

a rod rotatably supported parallel to said rotary shaft and having an eccentric large-diameter portion;

a driving mechanism for rotating said rod through a predetermined angle by rotation of said rotary shaft;

a tubular member rotatably fitted on said large-diameter portion of said rod to be displaced in a radial direction along with rotation of said rod; and a press mechanism for converting, while in surface contact with said tubular member, displacement of said tubular member into a press force in a direction perpendicular to said support shaft, to deflect said support shaft in the sheet convey direction.

2. An apparatus according to claim 1, wherein said press mechanism has a rotary member which converts the displacement of said tubular member into a rotational moment and exerts the rotational moment on said support shaft as a press force.

3. An apparatus according to claim 2, wherein said rotary member has an engaging portion with which said tubular member engages, and a support for supporting a central portion of said support shaft, and said rotary member generates the rotational moment upon displacement of said tubular member which acts on said engaging member, to press said central portion of said support shaft through said support.

4. An apparatus according to claim 3, wherein said engaging portion has a spring member for rotatably biasing said rotary member in a direction to come close to said tubular member, and said tubular member rotates said rotary member against a biasing force of said spring member in a direction in which said support shaft is deflected.

5. An apparatus according to claim 1, wherein said tubular member has a chamfered portion on an outer surface thereof to come into surface contact with said press mechanism, said chamfered portion of said tubular member serves to come into surface contact with said press mechanism during rotation of said rod, to transmit, in a substantially still state in a direction parallel to a contact surface, a press force according to a displacement of said tubular member to said press mechanism.

6. An apparatus according to claim 1, wherein said driving mechanism comprises a first cam member mounted on said rotary shaft, a second cam member engageable with said first cam member, and a proximal end portion fixed to said rod, and a lever member for supporting said second cam member.

7. An apparatus according to claim 6, wherein said first cam member comprises a semi-annular stationary cam fixed around said rotary shaft and having a pair of open ends, and a semi-annular movable cam movably supported around said rotary shaft, forming an annular cam surface together with said stationary cam, and having a pair of open ends, said second cam member comprises a cam follower which rotationally moves on cam surfaces of said stationary cam and said movable cam, and when said cam follower moves from said stationary cam to said movable cam, said lever member swings to rotate said rod.

8. An apparatus according to claim 7, wherein said open ends of said stationary and movable cams form thin plates, and said open ends of said stationary and movable cams are stacked on each other to form an annular cam surface.

9. An apparatus according to claim 7, further comprising a knob member which is rotationally operated, and an adjusting mechanism for adjusting a position of said movable cam with respect to said stationary cam by rotationally operating said knob member, wherein when said movable cam is positionally adjusted to accompany rotational operation of said knob member, a deflection amount of said support shaft is adjusted.

10. An apparatus according to claim 1, wherein said gripper units comprise gripper pads and grippers for gripping the sheet-like object in cooperation with said gripper pads.

11. An apparatus according to claim 10, wherein said support shaft comprises a gripper pad bar supported parallel to said rotary shaft to support said gripper pads in an array, and a gripper shaft supported parallel to said gripper pad bar to support said grippers in an array to correspond to said gripper pads.

* * * * *